US006705405B1

(12) United States Patent
Pietras

(10) Patent No.: US 6,705,405 B1
(45) Date of Patent: Mar. 16, 2004

(54) APPARATUS AND METHOD FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/762,606

(22) PCT Filed: Aug. 16, 1999

(86) PCT No.: PCT/GB99/02708

§ 371 (c)(1),
(2), (4) Date: May 10, 2001

(87) PCT Pub. No.: WO00/11310

PCT Pub. Date: Mar. 2, 2000

(30) Foreign Application Priority Data

Aug. 24, 1998 (GB) ..... 9818360

(51) Int. Cl.[7] ..... E21B 19/16

(52) U.S. Cl. ..... 166/380; 166/77.51; 175/203; 173/164; 81/57.33

(58) Field of Search ..... 81/57.15, 57.33; 166/380, 77.51, 78.1; 175/85, 203; 173/164

(56) References Cited

U.S. PATENT DOCUMENTS

| | | | | |
|---|---|---|---|---|
| 1,917,135 A | | 7/1933 | Littell | |
| 3,041,901 A | | 7/1962 | Knights | 81/53 |
| 3,193,116 A | | 7/1965 | Kenneday et al. | 214/2.5 |
| 3,380,528 A | | 4/1968 | Timmons | 166/14 |
| 3,566,505 A | | 3/1971 | Martin | 29/200 |
| 3,570,598 A | | 3/1971 | Johnson | 166/178 |
| 3,635,105 A | | 1/1972 | Dickmann et al. | 81/57.18 |
| 3,691,825 A | | 9/1972 | Dyer | 73/136 |
| 3,747,675 A | | 7/1973 | Brown | 166/237 |
| 3,766,991 A | | 10/1973 | Brown | 173/20 |
| 3,776,320 A | | 12/1973 | Brown | 173/163 |
| 3,848,684 A | | 11/1974 | West | 175/195 |
| 3,857,450 A | | 12/1974 | Guier | 175/85 |
| 3,913,687 A | | 10/1975 | Gyongyosi et al. | 175/85 |
| 4,100,968 A | | 7/1978 | Delano | 166/315 |
| 4,266,444 A | * | 5/1981 | Anderson et al. | 173/164 |
| 4,320,915 A | | 3/1982 | Abbott et al. | 294/96 |
| 4,437,363 A | | 3/1984 | Haynes | 81/57.18 |
| 4,449,596 A | | 5/1984 | Boyadjieff | 175/85 |
| 4,494,424 A | | 1/1985 | Bates | 81/57.18 |
| 4,529,045 A | | 7/1985 | Boyadjieff et al. | 173/164 |

(List continued on next page.)

FOREIGN PATENT DOCUMENTS

| | | | |
|---|---|---|---|
| EP | 01 62000 A1 | 11/1985 | E21B/19/16 |
| EP | 0 171 144 A1 | 2/1986 | E21B/19/06 |
| EP | 0 285 386 A2 | 10/1988 | E21B/19/16 |

(List continued on next page.)

OTHER PUBLICATIONS

LaFleur Petroleum Services, Inc., "Autoseal Circulating Head," Engineering Manufacturing, 1992, 11 Pages.

Valves Wellhead Equipment Safety Systems, W–K–M Division, ACF Industries, Catalog 80, 1980, 5 Pages.

"Canrig Top Drive Drilling Systems," Harts Petroleum Engineer International, Feb. 1997, 2 Pages.

(List continued on next page.)

*Primary Examiner*—David Bagnell
*Assistant Examiner*—Giovanna M Collins
(74) *Attorney, Agent, or Firm*—Moser, Patterson & Sheridan, L.L.P.

(57) ABSTRACT

An apparatus for facilitating the connection of tubulars using a top drive, the apparatus comprising a motor for rotating a tool for drivingly engaging a tubular, and a suspension unit for connecting the motor to the top drive, the apparatus being such that, in use, the motor can rotate one tubular with respect to another to connect the tubular.

14 Claims, 2 Drawing Sheets

U.S. PATENT DOCUMENTS

Figure 1:
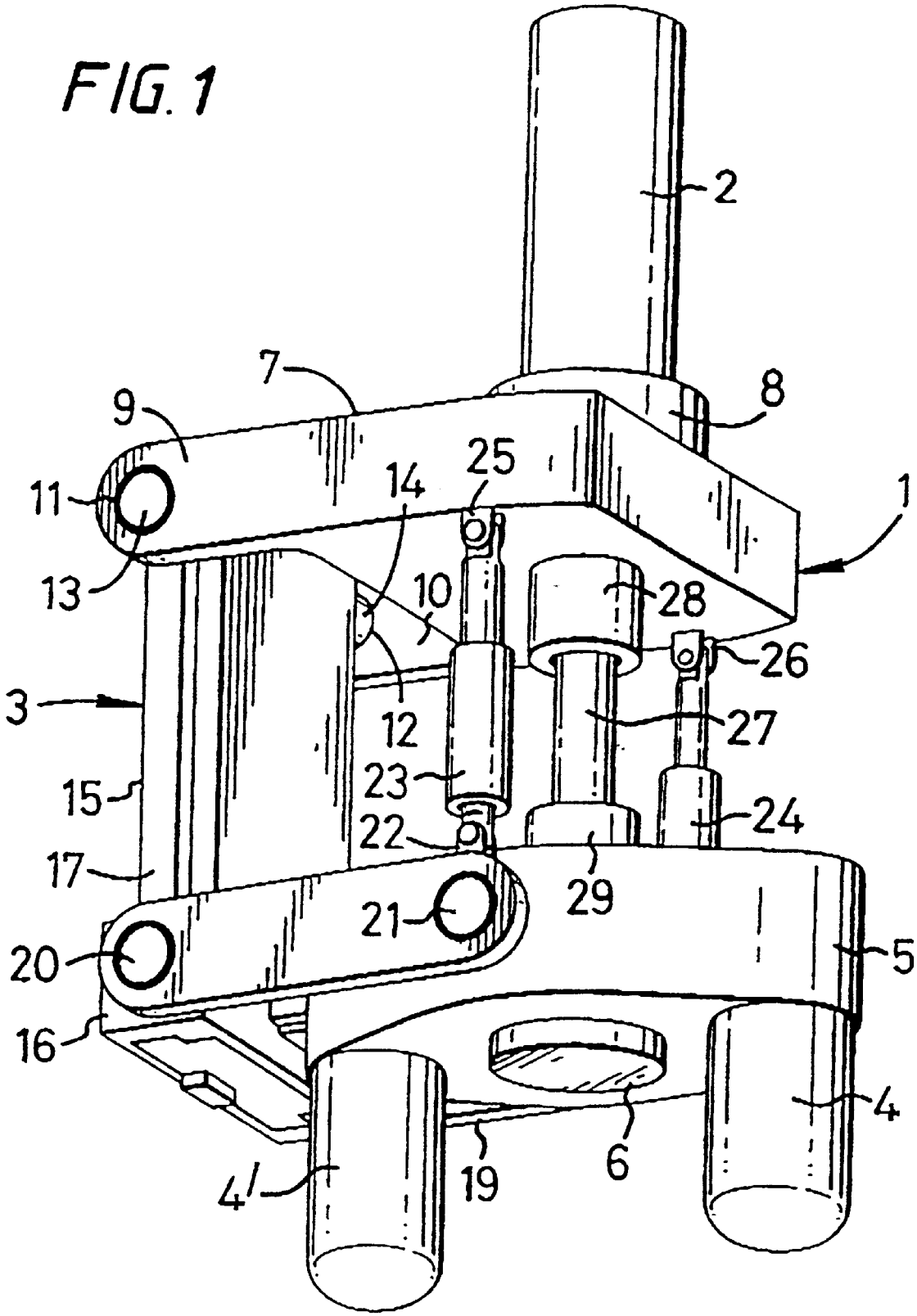

| | | | | |
|---|---|---|---|---|
| 4,570,706 | A | 2/1986 | Pugnet | 166/77.5 |
| 4,593,773 | A | 6/1986 | Skeie | 175/85 |
| 4,604,724 | A | 8/1986 | Shaginian et al. | 364/478 |
| 4,605,077 | A | 8/1986 | Boyadjieff | 175/85 |
| 4,625,796 | A | 12/1986 | Boyadjieff | 166/77.5 |
| 4,649,777 | A | 3/1987 | Buck | 81/57.19 |
| 4,676,312 | A | 6/1987 | Mosing et al. | 166/77 |
| 4,683,962 | A | 8/1987 | True | 173/163 |
| 4,709,599 | A | 12/1987 | Buck | 81/57.18 |
| 4,742,876 | A | 5/1988 | Barthelemy et al. | 175/7 |
| 4,754,807 | A | 7/1988 | Lange | 166/236 |
| 4,759,239 | A | 7/1988 | Hamilton et al. | 81/57.34 |
| 4,762,187 | A | 8/1988 | Haney | 175/171 |
| 4,765,401 | A | 8/1988 | Boyadjieff | 166/77.53 |
| 4,773,689 | A | 9/1988 | Wolters | 294/88 |
| 4,791,997 | A | 12/1988 | Krasnov | 175/57 |
| 4,793,422 | A | 12/1988 | Krasnov | 175/57 |
| 4,800,968 | A | 1/1989 | Shaw et al. | 175/85 |
| 4,813,493 | A | 3/1989 | Shaw et al. | 173/164 |
| 4,836,064 | A | 6/1989 | Slator | 81/57.18 |
| 4,867,236 | A | 9/1989 | Haney et al. | 166/77.5 |
| 4,878,546 | A | 11/1989 | Shaw et al. | 173/163 |
| 4,997,042 | A | 3/1991 | Jordan et al. | 166/379 |
| 5,009,265 | A | 4/1991 | Bailey et al. | 166/118 |
| 5,036,927 | A | 8/1991 | Willis | 175/162 |
| 5,191,939 | A | 3/1993 | Stokley | 166/379 |
| 5,251,709 | A | 10/1993 | Richardson | 175/220 |
| 5,255,751 | A | * 10/1993 | Stogner | 175/203 |
| 5,297,833 | A | 3/1994 | Willis et al. | 294/102.2 |
| 5,351,767 | A | 10/1994 | Stogner et al. | 175/162 |
| 5,388,651 | A | 2/1995 | Berry | 175/85 |
| 5,433,279 | A | 7/1995 | Tessari et al. | 173/213 |
| 5,501,286 | A | 3/1996 | Berry | 175/52 |
| 5,503,234 | A | 4/1996 | Clanton | 175/52 |
| 5,553,672 | A | 9/1996 | Smith, Jr. et al. | 166/382 |
| 5,577,566 | A | 11/1996 | Albright et al. | 175/321 |
| 5,584,343 | A | 12/1996 | Coone | 166/387 |
| 5,645,131 | A | 7/1997 | Trevisani | 175/171 |
| 5,735,348 | A | 4/1998 | Hawkins, III | 166/285 |
| 5,791,410 | A | 8/1998 | Castille et al. | 166/77.1 |
| 5,803,191 | A | 9/1998 | Mackintosh | 175/170 |
| 5,836,395 | A | 11/1998 | Budde | 166/321 |
| 5,839,330 | A | * 11/1998 | Stokka | 81/57.15 |
| 5,909,768 | A | 6/1999 | Castille et al. | 166/77.1 |
| 5,971,079 | A | 10/1999 | Mullins | 166/387 |
| 6,000,472 | A | 12/1999 | Albright et al. | 166/380 |
| 6,056,060 | A | 5/2000 | Abrahamsen et al. | 166/380 |
| 6,070,500 | A | 6/2000 | Dlask et al. | 81/57.33 |
| 6,161,617 | A | * 12/2000 | Gjedebo | 166/380 |
| 6,199,641 | B1 | 3/2001 | Downie et al. | 175/55 |
| 6,309,002 | B1 | 10/2001 | Bouligny | 294/86.25 |
| 6,311,792 | B1 | 11/2001 | Scott et al. | 175/162 |
| 6,349,764 | B1 | 2/2002 | Adams et al. | 166/77.53 |
| 6,360,633 | B2 | 3/2002 | Pietras | 81/57.34 |
| 6,412,554 | B1 | 7/2002 | Allen et al. | 166/80.1 |
| 6,431,626 | B1 | 8/2002 | Bouligny | 294/86.25 |
| 2001/0042625 | A1 | 11/2001 | Appleton | 166/379 |
| 2002/0134555 | A1 | 9/2002 | Allen et al. | 166/377 |

FOREIGN PATENT DOCUMENTS

| | | | |
|---|---|---|---|
| EP | 0 525 247 A1 | 2/1993 | E21B/3/02 |
| EP | 0 589 823 A1 | 3/1994 | E21B/19/06 |
| EP | 0 659 975 | 6/1995 | E21B/43/08 |
| GB | 2 224 481 A | 9/1990 | B66C/1/56 |
| GB | 2 275 486 A | 4/1993 | E21B/37/00 |
| GB | 2 357 530 A | 6/2001 | E21B/19/07 |
| WO | WO 93/07358 | 4/1993 | E21B/37/00 |
| WO | WO 96/18799 | 6/1996 | E21B/19/06 |
| WO | 97/17524 | 5/1997 | E21B/43/08 |
| WO | WO 98/05844 | 2/1998 | E21B/19/16 |
| WO | WO 98/11322 | 3/1998 | E21B/19/16 |
| WO | 98/22690 | 5/1998 | E21B/17/08 |
| WO | 98/32948 | 7/1998 | E21B/19/16 |
| WO | WO 00/05483 | 3/2000 | E21B/19/16 |
| WO | WO 00/11309 | 3/2000 | E21B/19/16 |
| WO | Wo 00/11310 | 3/2000 | E21B/19/16 |
| WO | WO 00/11311 | 3/2000 | E21B/19/16 |
| WO | WO 00/39429 | 7/2000 | E21B/19/16 |
| WO | WO 00/39430 | 7/2000 | E21B/19/16 |

OTHER PUBLICATIONS

"The Original Portable Top Drive Drilling System," TESCO Drilling Technology, 1997.

Killalea, Mike, "Portable Top Drives: What's Driving The Market?" IADC, Drilling Contractor, Sep. 1994, 4 pages.

"500 or 650 ECIS Top Drive," Advanced Permanent Magnet Motor Technology, TESCO Drilling Technology, Apr. 1998, 2 Pages.

"500 or 650 HCIS Top Drive," Powerful Hydraulic Compact Top Drive Drilling Systems, TESCO Drilling Technology, Apr. 1998, 2 Pages.

"Product Information (Sections 1–10)," CANRIG Drilling Technology, Ltd. Sep. 18, 1996.

* cited by examiner

APPARATUS AND METHOD FOR CONNECTING TUBULARS USING A TOP DRIVE

This invention relates to an apparatus for facilitating the connection of tubulars using a top drive and is more particularly, but not exclusively, intended for facilitating the connection of a section or stand of casing to a string of casing.

In the construction of oil or gas wells it is usually necessary to line the borehole with a string of tubulars known as a casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation there between. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on a platform, either on rails, or hung from a derrick on a chain. However, it has recently been proposed to use a top drive for making such connection. The normal use of such a top drive may be the driving of a drill string.

A problem associated with using a top drive for rotating tubulars in order to obtain a connection between tubulars is that some top drives are not specifically designed for rotating tubulars are not able to rotate at the correct speed or have non standard rotors.

According to the present invention there is provided an apparatus for facilitating the connection of tubulars using a top drive, said apparatus comprising a motor for rotating a tool for drivingly engaging a tubular, and means for connecting said motor to said top drive, the apparatus being such that, in use, said motor can rotate one tubular with respect to another to connect said tubulars.

Other features of the invention are set out in claims 2 et seq.

Figure 2:
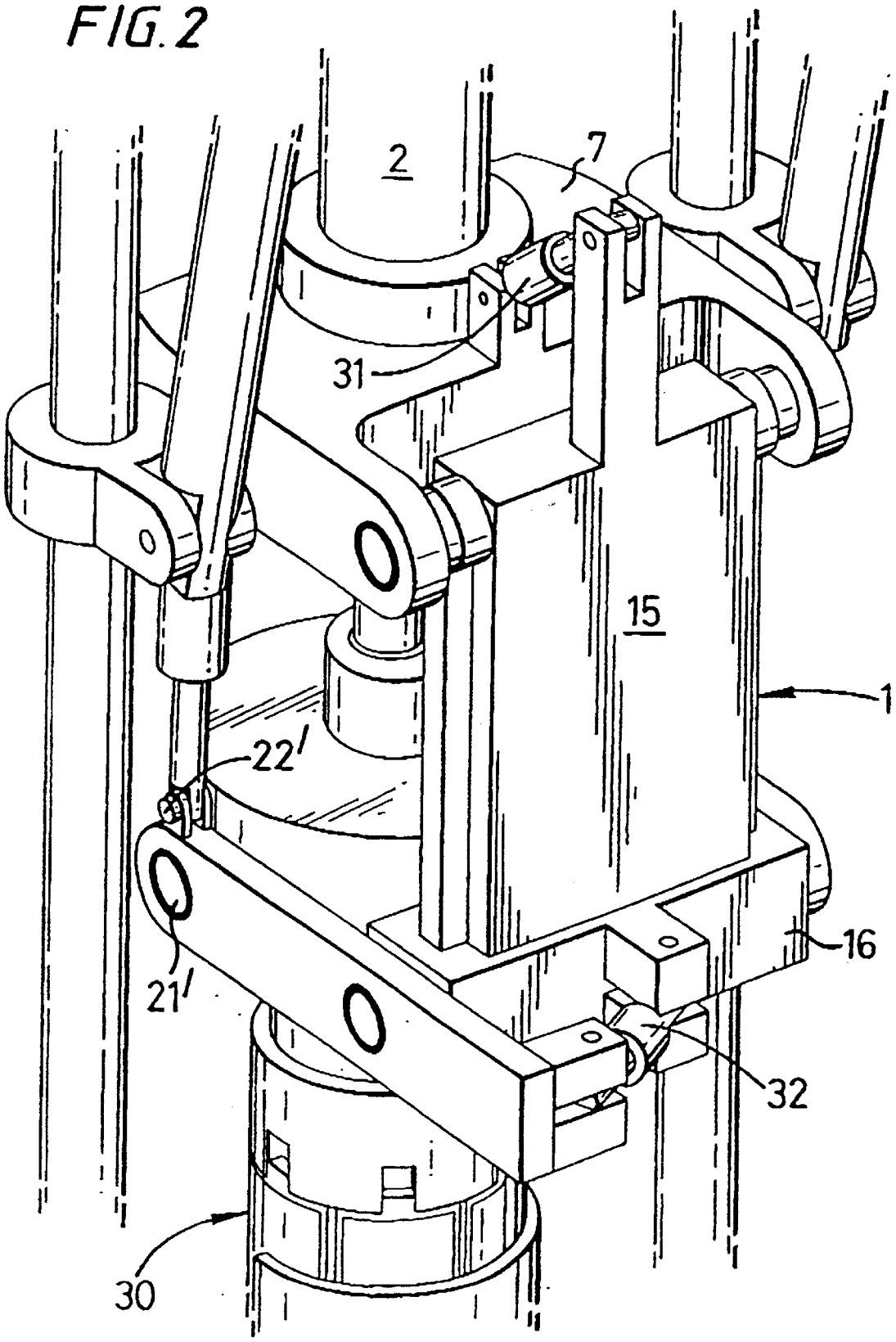

For a better understanding of the present invention and in order to show how the same may be carried into effect reference will now be made, by way of example, to the accompanying drawings, in which:

FIG. 1 is a front perspective view of an apparatus in accordance with the present invention; and FIG. 2 is a rear perspective view of the apparatus of FIG. 1 in use.

Referring to FIG. 1 there is shown an apparatus which is generally identified by reference numeral 1.

The apparatus 1 comprises a connecting tubular 2, a suspension unit 3 and a hydraulic motor 4 and 4'. The hydraulic motor 4,4' has a stator 5 and a rotor 6 and is driven by a supply of pressurised hydraulic fluid (the fluid supply lines are not illustrated in the Figures). The suspension unit 3 suspends the hydraulic motor 4,4' from the connecting tubular 2.

The suspension unit 3 comprises a plate 7 which is fixed to the connecting tubular 2 by a collar 8. The plate 7 has two projections 9 and 10 which have holes 11 and 12 for accommodating axles 13 and 14, which are rotationally disposed therein. The axles 13 and 14 are integral with a rigid body 15. A slider 16 is arranged on runners 17 and (not shown) on the rigid body 15. Arms 18 and 19 are connected at one end to the slider 16 via spherical bearings 20 and at the other end to each side of the stator 5 via spherical bearings 21 and 21'. The arms 18 and 19 are provided with lugs 22 and 22' to which one end of a piston and cylinder 23, 24 is attached and are movable thereabout. The other end of each piston and cylinder 23, 24 is attached to lugs 25, 26 respectively and is movable thereabout. A mud pipe 27 is provided between the plate 7 and the stator 5 for carrying mud to the inside of a tubular therebelow. The mud pipe 27 comprises curved outer surfaces at both ends (not shown) which are located in corresponding recesses in cylindrical sections 28, 29, thus allowing a ball and socket type movement between the plate 7 and the stator 5.

Referring to FIG. 2, the apparatus 1 is suspended from a top drive (not shown) via connecting shaft 2. A tool 30 for engaging with a tubular is suspended from beneath the rotor 6 of the hydraulic motor 4. Such a tool may be arranged to be inserted into the upper end of the tubular, with gripping elements of the tool being radially displaceable for engagement with the inner wall of the tubular so as to secure the tubular to the tool.

In use, a tubular (not shown) to be connected to a tubular string held in a spider (not shown) is located over the tool 30. The tool 30 grips the tubular. The apparatus 1 and the tubular are lowered by moving the top drive so that the tubular is in close proximity with the tubular string held in the spider. However, due to amongst other things manufacturing tolerances in the tubulars, the tubular often does not align perfectly with the tubular held in the spider. The suspension unit 3 allows minor vertical and horizontal movements to be made by using alignment pistons 31 and 32 for horizontal movements, and piston and cylinders 23 and 24 for vertical movements. The alignment piston 31 acts between the rigid body 15 and the plate 7. The alignment piston 32 acts between the slider 16 and the arm 19. The alignment pistons 31 and 32 and pistons and cylinders 23, 25 are actuated by hydraulic or pneumatic means and controlled from a remote control device.

The piston and cylinders 23, 24 are hydraulically operable. It is envisaged however, that the piston and cylinders 23, 24 may be of the pneumatic compensating type, i.e., their internal pressure may be adjusted to compensate for the weight of the tubular so that movement of the tubular may be conducted with minimal force. This can conveniently be achieved by introducing pneumatic fluid into the piston and cylinder 23, 24 and adjusting the pressure therein.

Once the tubulars are aligned, the hydraulic motor 4 and 4' rotate the tubular via gearing in the stator 5 thereby making up the severed connection. During connection the compensating piston and cylinders 23, 24 expand to accommodate the movement of the upper tubular. The alignment pistons 31 and 32 can then be used to move the top of the tubular into alignment with the top drive. If necessary, final torquing can be conducted by the top drive at this stage, via rotation of the pipe 27, and the main elevator can also be swung onto and connected to the tubular prior to releasing the slips in the spider and lowering the casing string. It will be appreciated that the suspension unit 3 effectively provides an adapter for connecting a top drive to the tubular engaging tool 30.

What is claimed is:

1. Apparatus for facilitating the connection of tubulars using a top drive, the apparatus comprising a motor for rotating a tool for drivingly engaging a first tubular to rotate the first tubular with respect to a second tubular to connect said tubulars, and a suspension unit for connecting the motor to the top drive, wherein the suspension unit allows the motor to move in at least two planes.

2. An apparatus as claimed in claim 1, wherein said motor is hydraulically operable.

3. An apparatus as claimed in claim 1, wherein the apparatus is supported by the top drive.

4. An apparatus as claimed in claim 1, wherein said suspension unit can, in use, move said motor relative to the axis of said top drive to facilitate aligning said tubulars.

5. An apparatus as claimed in claim 4, wherein said suspension unit is provided with at least one piston and cylinder in order to raise and lower said motor.

6. An apparatus as claimed in claim 5, wherein said at least one piston and cylinder can be pneumatically actuated to compensate for the weight of said tubular.

7. An apparatus as claimed in claim 1, wherein said suspension unit comprises spherical bearings planes.

8. An apparatus as claimed in claim 1, wherein said suspension unit comprises adjustable pistons and cylinders to position said motor.

9. An apparatus as claimed in claim 1, comprising a mud pipe for delivering mud to said tubular.

10. An apparatus as claimed in claim 9, wherein said mud pipe is provided with a ball joint at both ends thereof.

11. A method of connecting first and second tubulars for use in lining a borehole, the method comprising:

coupling said first tubular to a top drive using a suspension unit, wherein the tubular engages a rotor of a motor supported by the suspension unit, whereby the suspension unit allows the motor to move in at least two planes;

engaging a lower end of said first tubular with an upper end of said second tubular;

rotating said first tubular using the motor so as to screw the tubulars together; and tightening the connection between the tubulars by rotating the first tubular using the top drive.

12. A method according to claim 10, the method comprising adjusting the suspension unit prior to tightening the connection using the top drive so as to bring the first tubular into alignment with the top drive.

13. Apparatus for facilitating the connection of tubulars using a top drive, the apparatus comprising:

a motor for rotating a tool for drivingly engaging a first tubular to rotate the first tubular with respect to a second tubular to connect the tubulars; and a suspension unit for connecting the motor to the top drive, wherein the suspension unit can, in use, move said motor relative to the axis of the tope drive to facilitate aligning the tubulars and includes at least one piston and cylinder in order to raise and lower the motor, wherein the at least one piston and cylinder can be pneumatically actuated to compensate for the weight of the first tubular.

14. Apparatus for facilitating the connection of tubulars using a top drive, the apparatus comprising:

a motor for rotating a tool for drivingly engaging a first tubular to rotate the first tubular with respect to a second tubular to connect the tubulars;

a suspension unit for connecting the motor to the top drive; and a mud pipe for delivering mud to the first tubular, wherein the mud pipe includes a ball joint at both ends thereof.

* * * * *

UNITED STATES PATENT AND TRADEMARK OFFICE

CERTIFICATE OF CORRECTION

PATENT NO. : 6,705,405 B1
DATED : March 16, 2004
INVENTOR(S) : Pietras

It is certified that error appears in the above-identified patent and that said Letters Patent is hereby corrected as shown below:

Column 4,
Line 20, please change “tope” to -- top --.

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,705,405 B1
DATED : March 16, 2004
INVENTOR(S) : Pietras

It is certified that error appears in the above-identified patent and that said Letters Patent is hereby corrected as shown below:

Column 3,
Line 23, please remove "planes".

Signed and Sealed this

Seventh Day of June, 2005

JON W. DUDAS
*Director of the United States Patent and Trademark Office*